United States Patent [19]

Hawkrige

[11] Patent Number: 4,869,379

[45] Date of Patent: Sep. 26, 1989

[54] STORAGE DEVICE

[76] Inventor: Alfred E. Hawkrige, 16 Kasper Street, Malanshoft Ext. 5, Randburg, Transvaal, South Africa

[21] Appl. No.: 102,560

[22] Filed: Sep. 29, 1987

[30] Foreign Application Priority Data

Sep. 30, 1986 [ZA] South Africa ..... 86/7433

[51] Int. Cl.[4] ..... A47F 7/19

[52] U.S. Cl. ..... 211/100; 211/94; 211/99; 211/171

[58] Field of Search ..... 211/96, 116, 115, 94, 211/94.5, 99, 100, 170, 171

[56] References Cited

U.S. PATENT DOCUMENTS 850,363 4/1907 Frankel ..... 211/94
2,412,011 12/1946 Sanderson ..... 211/99
2,812,067 11/1957 Gussack ..... 211/94 X
4,109,794 8/1978 Samuel et al. ..... 211/100 X
4,126,231 11/1978 Derwent-Wryde ..... 211/99

FOREIGN PATENT DOCUMENTS 1008516 10/1965 United Kingdom ..... 211/116

*Primary Examiner*—Robert W. Gibson, Jr.
*Attorney, Agent, or Firm*—Mason, Fenwick & Lawrence

[57] ABSTRACT

A storage device has hangers for individual articles such as garments spaced along a beam which is movable between a first position in which the hangers are generally in a vertical array and a second position in which they are in horizontal array. The device is adapted to be installed in a closet, where the beam can be projected to the outside of the closet and then rotated to its second position. In a variant, the device is part of a mobile clothes' horse.

15 Claims, 2 Drawing Sheets

STORAGE DEVICE

BACKGROUND OF THE INVENTION

This invention relates the storage of articles which are suspended parallel to one another from a beam. Typical of such articles are garments such as trousers, skirts, shirts, etc.

BACKGROUND OF THE INVENTION

In conventional storage devides, the minimum horizontal space required for storage is dictated by the need to be able to withdraw any one of the articles from the array without unacceptable interference from or with its neighbours.

the object of this invention is to provide a device which significantly increases the number of articles that can be usefully stored relatively to conventional devices.

THE INVENTION

The invention provides a storage device having a beam, a plurality of hangers spaced from one another on the beam, each hanger being adapted to support an individual article, the beam being movable between a first position in which the hangers are disposed in a generally vertically extending array and a second position at which the hangers are disposed in a horizontal array.

Further according to the invention, the beam is mounted on a bearer and is movable relatively thereto between its two positions.

THE DRAWINGS

Embodiments of the invention are seen in the accompanying drawings in which.

DESCRIPTION OF THE ILLUSTRATED EMBODIMENTS

Figure 1:
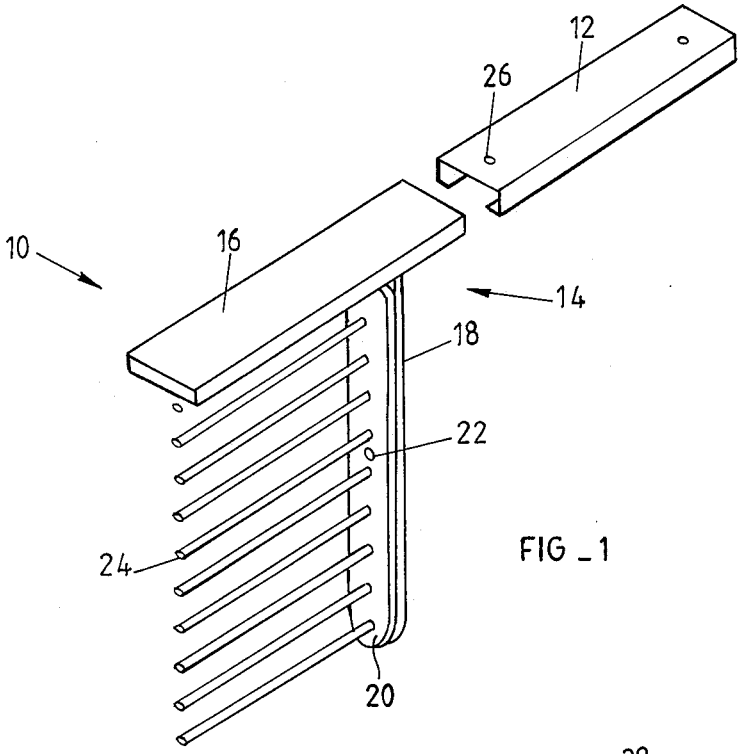
FIG. 1 is a perspective view, partially exploded, of a storage device according to the invention.

FIG. 1 illustrates a storage means 10 according to the invention, which includes a base, preferably a channel member 12, and an L- (or T-) shaped assembly 14 consisting of a horizontal bearer 16; an arm 18 depending from the bearer and at right angles to it; a beam 20 which is mounted on the arm about a pivot 22; and a plurality of hangers 24, which may be a series of parallel rods, as in the drawing, or a series of coat hangers engaged in a line of holes in the beam.

For clarity of illustration, the bearer 16 is shown detached from the channel 12. In fact, of course, it is located telescopically within it and is constrained against any movement relative to it other then linear. A suitable stop is provided to limit its movement out of the channel.

Figure 2:
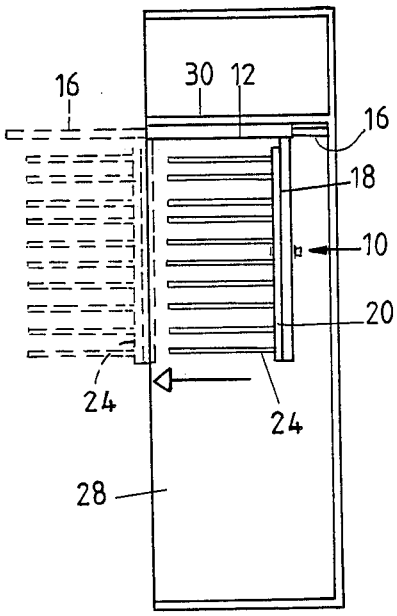
FIG. 2 is a side view of the storage device of FIG. 1 installed in a wardrobe.
Figure 3:
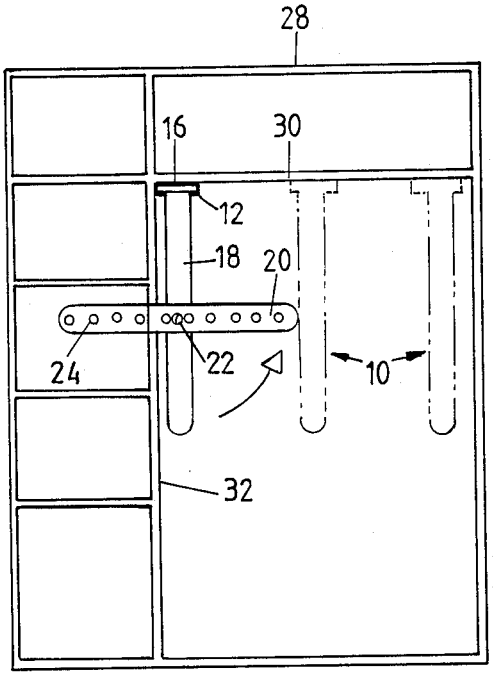
FIG. 3 is a front view of the installed storage device shown in FIG. 2.
Figure 5:
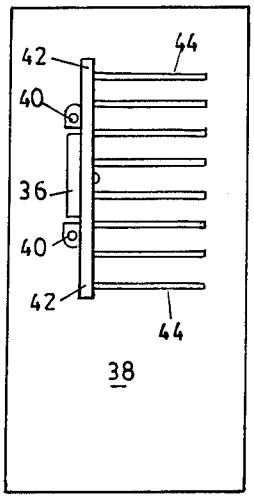
FIG. 5 is face view of the device of FIG. 4 in retracted position.
Figure 7:
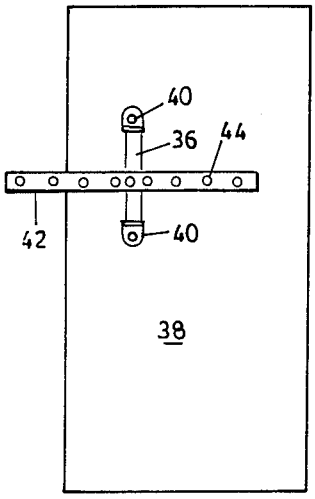
FIG. 7 is a face view of the device of FIG. 4 in extended position.
Figure 6:
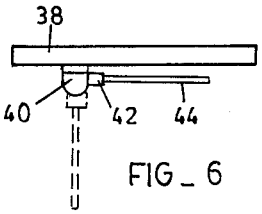
FIG. 6 is a plan view of FIG. 5.

FIGS. 2 and 3 illustrate the manner of use of the storage device 10. The storage device is mounted inside a wardrobe 28 with the channel 12 fixed to an under surface of a horizontal shelf 30 by means of screws or bolts, which pass through the holes 26 in the channel.

The channel is so positioned that when the bearer 16 is pushed home into the channel, the hangers 24 are wholly within the wardrobe, to offer no obstacle to the door of the wardrobe being closed. With the door open, the bearer 16 is retracted from the channel to the dotted line position shown in the left of FIG. 2, in which position the beam 20 is outside the contours of the wardrobe.

When the beam 20 is in the dotted line position shown in FIG. 2, i.e. when the beam is fully extended from the channel 12, then the beam 20 is rotated about the pivot point 22 to the FIG. 3 position, in which the beam 20 is horizontal. The hangers are then disposed in a horizontal array. Articles of clothing, for example a plurality of pairs of trousers, can then be individually hung on the hangers or withdrawn from them without interference with or from trousers hanging from adjacent hangers.

On the contrary, with the device in the FIG. 2 position, within a closet 28, the articles of clothing suspended therefrom are held in a compact and stable manner on the hangers, bunched together, and selection and removal of an individual article is, to say the least, difficult. However, easy access to all the hangers and to the articles of clothing engaged therewith is afforded to a user merely by moving the beam to the FIG. 3 position. It is, of course, necessary that the channel 12 be so located in the closet that clothes on the hangers do not snag or catch on the adjacent wall 32 of the closet.

The success of the storage means of the invention is dependent upon enough space being available below the beam to accommodate the suspended articles when the beam is in retracted position, which is almost invariably the case in wardrobes. The normally dead space below the articles is thus made use of when the bearer has been retracted and the array of hangers are more or less vertical.

While the use of a single assembly is in itself useful, it is at this stage that a major benefit of the invention emerges. A number of hanger assemblies can be mounted side by side in the wardrobe 28, as is seen in FIG. 3 at 34. The bearer of any of the assemblies 34 can be individually withdrawn, the beam rotated and articles attached or detached from the hangers while the other assemblies remain undisturbed. All that must be catered for is that the assemblies be sufficiently far apart for space to be provided for the arrays of articles when they are hanging with the bearer in vertical position.

The result of this is that a considerably greater number of articles can be hung in the closet space than is currently possible, yet all the articles are individually accessible.

Figure 8:
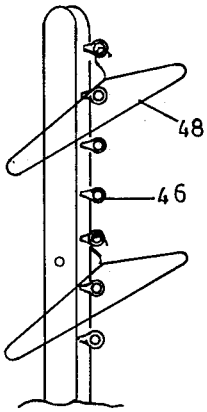
FIG. 8 is a perspective view of a different form of hangers.

In the embodiment pictured in FIGS. 4 to 7, a post 36, equivalent to the arm 18 of FIGS. 1 to 3, is mounted on the door 38 of a closet, on two spaced lugs 40. The bearer 42 is pivotally mounted on the lugs, so that it can be rotated from the stowed position seen in FIGS. 5 and 6, into the extended position of FIG. 7. The hangers may be rods 44 as in the earlier embodiment, or they may be a line of hooks 46, as is seen in FIG. 8, from which coat hangers 48 can be suspended.

Sufficient space must, or course, be provided for the articles on the stowed hangers to be clear of garments hanging in the closet.

A feature of these embodimements is that the storage means can so readily be added to an existing closet.

Figure 9:
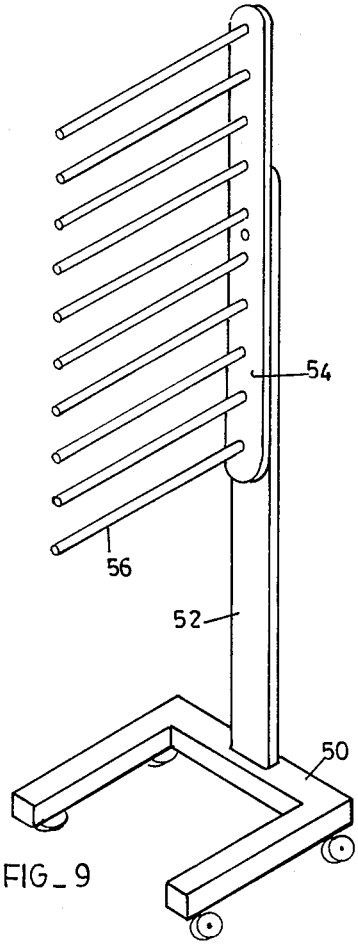
FIG. 9 is a perspective view of a mobile storage device.
Figure 4:
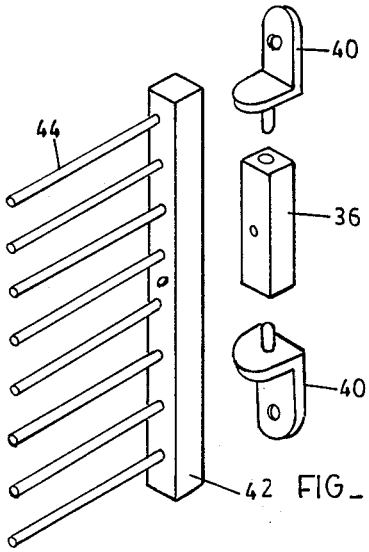
FIG. 4 is an exploded perspective view of an embodiment of the invention for hanging ties and like elongated articles.

A mobile storage device is seen in FIG. 9. The device includes a wheeled base 50, a post 52 which is the equivalent of the arm 18 of FIGS. 1 to 3 and of the post 36 of FIGS. 4 to 7; a beam 54; and a line of hangers 56.

Some means may be provided to hold the hangers in retracted or projected positions. The nature of such means is not critical: it may be, for instance, a frictional restraint or a spring-loaded catch. For example, by means of a simple detent the beam 20 can be kept in the horizontal position shown in FIG. 3 with a degree of rigidity that ensures that articles of clothing can be attached to the hangers, or be removed from them, without upsetting the equilibrium of the assembly. On the other hand only a moderate amount of effort is required in order to rotate the member 20, together with the articles of clothing suspended therefrom, to a vertical orientation.

I claim:

1. A device for selectively suspending a plurality of articles parallel to one another in a generally vertical array for compact storage of said articles and a generally horizontal array for providing ready access to each of said articles, comprising:

a support member;

an elongate beam having first and second ends and a pivot point substantially offset from said first and second ends, said beam being movable between a first, storage position in which said beam is substantially vertical and a second, access position in which said beam is substantially horizontal;

pivot means for pivotably supporting said beam on said support member for rotation in a vertical plane about said pivot point between said first, storage position and said second, access position; and a plurality of hanger means mounted on said beam in a linear array, said hanger means comprising hooks adapted to receive the hooks of coat hangers, some of said hanger means being mounted on said beam intermediate said first end and said pivot point and the remainder of said hanger means being mounted on said beam intermediate said second end and said pivot point, said hanger means being disposed in a generally vertical array when said beam is in said first position and in a generally horizontal array when said beam is in said second position, whereby the articles are suspended parallel to one another in a generally vertical array for compact storage when said beam is in said first position and in a generally horizontal array for providing ready access to each of said articles when said beam is in said second position.

2. A storage device for storing a plurality of articles suspended parallel to one another in a first position for storage and a second position for access, comprising:

a bearer member;

base means adapted to be mounted on a fixed structure for telescopically supporting said bearer member for linear movement in a horizontal plane;

a support member mounted on said bearer member;

an elongate beam having first and second ends and a pivot point substantially offset from said first and second ends;

pivot means for pivotably supporting said beam on said support member for rotation in a vertical plane about said pivot point between a first, storage position in which said beam is substantially vertical and a second, access position in which said beam is substantially horizontal; and a plurality of hanger means mounted on said beam in a linear array, each for supporting at least one article, some of said hanger means being mounted on said beam intermediate said first end and said pivot point and the remainder of said hanger means being mounted on said beam intermediate said second end and said pivot point, said hanger means being disposed in a generally vertical array when said beam is in said first position and in a generally horizontal array when said beam is in said second position.

3. A closet having a plurality of devices for selectively suspending a plurality of articles parallel to one another in a generally vertical array for compact storage of said articles and a generally horizontal array for providing ready access to each of said articles, each of said devices comprising:

a support member;

an elongate beam having first and second ends and a pivot point substantially offset from said first and second ends, said beam being movable between a first, storage position in which said beam is substantially vertical and a second, access position in which said beam is substantially horizontal;

pivot means for pivotably supporting said beam on said support member for rotation in a vertical plane about said pivot point between said first, storage position and said second, access position; and a plurality of hanger means mounted on said beam in a linear array, each for supporting at least one article, some of said hanger means being mounted on said beam intermediate said first end and said pivot point and the remainder of said hanger means being mounted on said beam intermediate said second end and said pivot point, said hanger means being disposed in a generally vertical array when said beam is in said first position and in a generally horizontal array whenf said beam is in said second position, whereby the articles are suspended parallel to one another in a generally vertical array for compact storage when said beam is in said first position and in a generally horizontal array for providing ready access to each of said articles when said beam is in said second position.

4. A closet having a plurality of storage devices for storing a plurality of articles suspended parallel to one another in a first position for storage and a second position for access, each of said storage devices comprising:

a bearer member;

base means adapted to be mounted on a fixed structure for telescopically supporting said bearer member for linear movement in a horizontal plane;

a support member mounted on said bearer member;

an elongate beam having first and second ends and a pivot point substantially offset from said first and second ends;

pivot means for pivotably supporting said beam on said support member for rotation in a vertical plane about said pivot point between a first, storage position in which said beam is substantially vertical and a second, access position in which said beam is substantially horizontal; and a plurality of hanger means mounted on said beam in a linear array, each for supporting at least one article, some of said hanger means being mounted on said beam intermediate said first end and said pivot point and the remainder of said hanger means being mounted on said beam intermediate said second end and said pivot point, said hanger means being disposed in a generally vertical array when said beam is in said first position and in a generally horizontal array when said beam is in said second position.

5. A closet having therein a device for selectively suspending a plurality of articles parallel to one another in a generally vertical array for compact storage of said articles and a generally horizontal array for providing ready access to each of said articles, said device comprising:

a support member;

an elongate beam having first and second ends and a pivot point substantially offset from said first and second ends, said beam being movable between a first, storage position in which said beam is substantially vertical and a second, access position in which said beam is substantially horizontal;

pivot means for pivotably supporting said beam on said support member for rotation in a vertical plane about said pivot point between said first, storage position and said second, access position; and a plurality of hanger means mounted on said beam in a linear array, said hanger means comprising hooks adapted to receive the hooks of coat hangers, some of said hanger means being mounted on said beam intermediate said first end and said pivot point and the remainder of said hanger means being mounted on said beam intermediate said second end and said pivot point, said hanger means being disposed in a generally vertical array when said beam is in said first position and in a generally horizontal array when said beam is in said second position, whereby the articles are suspended parallel to one another in a generally vertical array for compact storage when said beam is in said first position and in a generally horizontal array for providing ready access to each of said articles when said beam is in said second position.

6. A closet having therein a storage device for storing a plurality of articles suspended parallel to one another in a first position for storage and a second position for access, said storage device comprising:

a bearer member;

base means adapted to be mounted on a fixed structure for telescopically supporting said bearer member for linear movement in a horizontal plane;

a support member mounted on said bearer member;

an elongate beam having first and second ends and a pivot point substantially offset from said first and second ends;

pivot means for pivotably supporting said beam on said support member for rotation in a vertical plane about said pivot point between a first, storage position in which said beam is substantially vertical and a second, access position in which said beam is substantially horizontal; and a plurality of hanger means mounted on said beam in a linear array, each for supporting at least one article, some of said hanger means being mounted on said beam intermediate said first end and said pivot point and the remainder of said hanger means being mounted on said beam intermediate said second end and said pivot point, said hanger means being disposed in a generally vertical array when said beam is in said first position and in a generally horizontal array when said beam is in said second position.

7. The device of claim 2, said hanger means comprising rods projecting from said beam.

8. The device of claim 2, said hanger means comprising hooks adapted to receive the hooks of coat hangers.

9. The device of claim 2, further comprising a wheeled base, said support member comprising a post mounted on said wheeled base.

10. The device of claim 3, said hanger means comprising rods projecting from said beam.

11. The device of claim 3, said hanger means comprising hooks adapted to receive the hooks of coat hangers.

12. The device of claim 4, said hanger means comprising rods projecting from said beam.

13. The device of claim 4, said hanger means comprising hooks adapted to receive the hooks of coat hangers.

14. The device of claim 6, said hanger means comprising rods projecting from said beam.

15. The device of claim 6, said hanger means comprising hooks adapted to receive the hooks of coat hangers.

* * * * *